US006130698A

United States Patent [19]

Katsuda et al.

[11] Patent Number: 6,130,698

[45] **Date of Patent: *Oct. 10, 2000**

[54] HEAT TRANSFER PRINTER

[75] Inventors: Takeo Katsuda, Kawasaki; Kazuhiko Makiishi, Hadano, both of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/529,662

[22] Filed: Sep. 18, 1995

[30] Foreign Application Priority Data

Sep. 20, 1994 [JP] Japan ..... 6-224714

[51] Int. Cl.[7] ..... B41J 2/325

[52] U.S. Cl. ..... 347/212; 347/206

[58] Field of Search ..... 347/212, 200, 347/206, 207; 400/120.18

[56] References Cited

U.S. PATENT DOCUMENTS

| | | | |
|---|---|---|---|
| 4,746,933 | 5/1988 | Asakura | 347/200 |
| 4,815,872 | 3/1989 | Nagashima | 400/120.18 |
| 5,277,501 | 1/1994 | Tanaka et al. | 400/120.18 |

FOREIGN PATENT DOCUMENTS

| | | | |
|---|---|---|---|
| 58-148778 | 9/1983 | Japan . | |
| 2-026760 | 1/1990 | Japan | 347/206 |
| 5-042698 | 2/1993 | Japan | 347/206 |
| 6-127007 | 5/1994 | Japan | 347/206 |

*Primary Examiner*—Huan Tran

*Attorney, Agent, or Firm*—Sidley & Austin

[57] ABSTRACT

A heat transfer printer which produces an image on a sheet by heating an ink member in accordance with image data and thereafter transfers a transparent overcoat material on the image formed. The heat transfer printer is provided with a thermal head having a heat insulating portion at a region other a region where the overcoat material is transferred for insulating heat produced within the overcoat material transfer region.

19 Claims, 9 Drawing Sheets

HEAT TRANSFER PRINTER

BACKGROUND OF THE INVENTION

1. Field of the Invention

The present invention relates to heat transfer printers, and more particularly to heat transfer printers adapted to cover images with a transparent overcoat material.

2. Description of the Related Art

Heat transfer printers for forming color images are conventionally provided. It is practice with such heat transfer printers to cover color images with a transparent overcoat material to prevent fingerprints from adhering to the color image, protect the color image from exposure to chemicals or the like, or preclude the discoloration of the color image due to light.

A description will be given of the operation of the heat transfer printer from the formation of a color image to the transfer (adhesion) of an overcoat material onto the color image formed.

With reference to FIG. 1, an ink film 5 for use in the heat transfer printer has yellow (Y), magenta (M) and cyan (C) color ink faces and a face of overcoat material (O). These color ink faces and overcoat material face are arranged in this order repeatedly to constitute a roll of ink film 5. The ink film 5 and recording paper are nipped between a thermal head and a platen roller, and the ink or the overcoat material is transferred from the ink film 5 onto the recording paper by applying a voltage to the thermal head and thereby heating a plurality of heaters provided inside the head.

In FIG. 1, the region A indicates the width of the recording paper. The region B, which is smaller than the region A, stands for the transfer region of the Y, M or C color ink face. The region C, which is intermediate between the regions A and B, indicates the transfer region of the overcoat material.

When a color image is to be formed by the heat transfer printer, electric power to be supplied to the heaters inside the thermal head is controlled first based on image data sent to the printer as to yellow for every line (pulse data indicating which dots are to be colored and what tone of color is to be given). The power to be supplied to the heaters is controlled, for example, by pulse width control. More specifically, a voltage is applied to the heaters corresponding to particular dots to be colored yellow, with the color tone adjusted by varying the duration of voltage application.

The pulse voltage controlled based on the image data for every line is applied to the specified heaters inside the thermal head, whereby the ink at the portions of the yellow (Y) ink face which are in contact with the energized heaters is adhered to the recording paper. Transport of the paper line by line produces a yellow print. The operation described is similarly performed also for the ink faces of magenta (M) and cyan (C) to form a color image. The overcoat material, which is transparent, is subsequently transferred onto the color image on the recording paper by the thermal head.

FIG. 2 shows the overcoat material in contact with the surface of the color image 14. The overcoat material comprises a thermoplastic overcoat layer 12 formed beneath substrate 10. The overcoat layer 12 is peeled off the substrate 10 by the heat applied to the thermal head and transferred to the surface of the color image 14 on the recording paper.

The state in which the overcoat layer 12 is peeled from the substrate 10 is influenced by the quantity of heat produced by the thermal head, in other words, by the quantity of heat given to the overcoat material. When the quantity of heat produced by the thermal head 20 is proper, the overcoat layer 12 is neatly peeled off the substrate 10, forming a smooth and very glossy surface over the color image 14 upon transfer, as shown in FIG. 3 (*a*). On the other hand, if the thermal head 20 produces an excessively large quantity of heat, the overcoat layer 12, although transferred onto the color image 14, becomes rough-surfaced owing to thermal deterioration, as seen in FIG. 3 (*b*), loses gloss from its surface. If producing too small a quantity of heat, the thermal head 20 encounters difficulty in completely transferring the overcoat layer 12 onto the color image 14. Failing to neatly peel the layer 12 from the substrate 10, the overcoat layer 12 transferred to the surface of the color image 14 is locally torn off, as shown in FIG. 3 (*c*).

In order to neatly transfer the overcoat layer 12 onto the color image 14, it is accordingly necessary for the thermal head 20 to produce a quantity of heat larger than is needed for completely transferring the overcoat layer 12 onto the image 14 but less than a quantity that will thermally deteriorate the surface of the overcoat layer 12 as transferred. When the overcoat material is to be heat-transferred by the conventional heat transfer printer, a pulse voltage is determined and then applied to the thermal head 20 which voltage is optimum to give a quantity of heat fulfilling the above requirement.

However, in the case where the overcoat material is transferred by applying the optimum pulse voltage determined, it is likely that the overcoat material, failing to peel off the substrate 10 neatly, will not be completely transferred to the recording paper at the end portions of the overcoat material transfer region C (see FIG. 1), i.e., at the boundary portions between the overcoat material transfer portion and the nontransfer portion. This is attributable to the quantity of heat of the thermal head 20 at the portions thereof corresponding to the transfer boundary portions of the overcoat material.

Referring to FIG. 4 (*a*), the conventional thermal head 20, comprises a plurality of heaters 21 arranged in corresponding relation with the overcoat material transfer region C shown in FIG. 1, and a head base plate 22 provided outside the transfer region C to hold the heaters 21. For the heat-transfer of the overcoat material to the surface of the color image 14, all the heaters 21 usually produce heat, so that the distribution of heat from the heaters 21 corresponding to the end portions E of the overcoat material transfer region C to the head base plate 22 exhibit a gentle curve, as shown in FIG. 4 (*b*).

Stated more specifically with reference to FIG. 4 (*b*), the end portions E of the overcoat material transfer region C are heated to a temperature range higher than a temperature T1 at which the overcoat layer 12 can be adhered to the surface of the color image 14 and lower than a temperature T2 at which the layer 12 can be reliably adhered to the color image surface, i.e., a temperature range Y in which the adhesion of the overcoat layer 12 to the image surface is unstable. Consequently, the overcoat layer 12 locally fails to neatly peel off the substrate 10 for complete transfer at the end portions E of the overcoat material.

In the case where the overcoat material fails to neatly peel off the substrate 10 at the boundary portions, the transfer boundary portions 8*a* are torn off raggedly and transferred in a faulty state instead of becoming straight, as shown in FIG. 5. As a result, the color image at the boundary portions is liable to become impaired by fingerprints, chemicals or light because of incomplete transfer of the overcoat material at these protions. If the overcoat layer 12 is torn off from the substrate 10 instead of being neatly peeled off, another problem is encountered in that minute fragments of the overcoat material are created to adhere to another sheet of recording paper subsequently transported, with the result that the image to be printed will be partly left unprinted on the subsequent sheet. Furthermore, fragments of the overcoat material will adhere to the surface of the paper discharge roller, giving rise to the problem of faulty transport of paper. Another problem also arises in that such fragments impair the aesthetic appearance of prints.

SUMMARY OF THE INVENTION

The main object of the present invention is to provide a heat transfer printer adapted to produce satisfactory color images.

Another object of the invention is to provide a heat transfer printer capable of producing prints of color images which will not be impaired by fingerprints, chemicals or light.

Still another object of the invention is to provide a heat transfer printer adapted to neatly transfer a transparent overcoat material onto color images.

These objects of the present invention are accomplished by a heat transfer printer for producing an image on a sheet comprising:

an ink member, a transparent overcoat material, and a thermal head pressed against the sheet with the ink member or the overcoat material interposed therebetween for forming the image on the sheet by heating the ink member in accordance with image data and for transferring the overcoat material onto the image formed, the thermal head having a heat insulating portion at a region other than a region where the overcoat material is transferred for insulating heat produced within the overcoat material transfer region.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 3 (*b*) is a diagram showing the overcoat layer while it is being peeled off the substrate when the thermal head produces an excessively large quantity of heat;

FIG. 3 (*c*) is a diagram showing the overcoat layer while it is being peeled off the substrate when the thermal head produces too small a quantity of heat;

FIG. 4 (*b*) is a diagram showing the heat distribution in the heating region of the thermal head shown in FIG. 4 (*a*);

FIG. 9 (*b*) is a diagram showing a heat distribution in the heating region of the thermal head shown in FIG. 9 (*a*)

DESCRIPTION OF THE PREFERRED EMBODIMENTS

Figure 1:
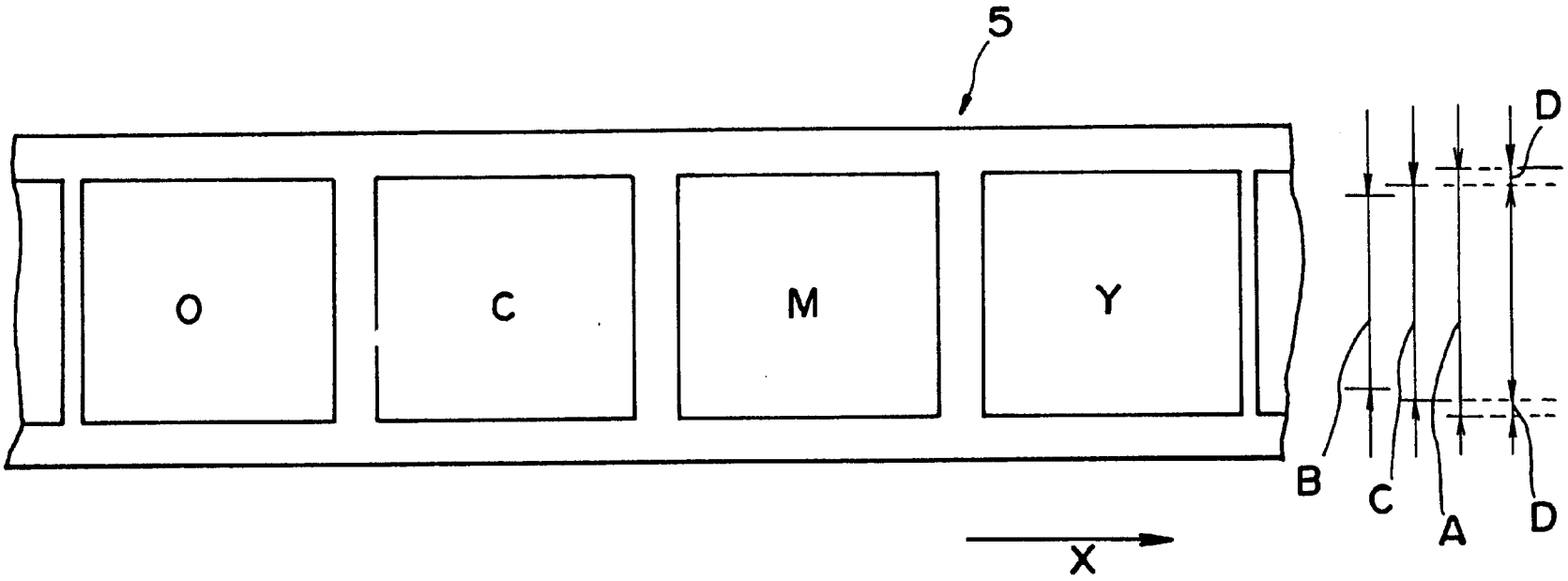
FIG. 1 is a diagram showing the construction of an ink film having an overcoat material.
Figure 2:
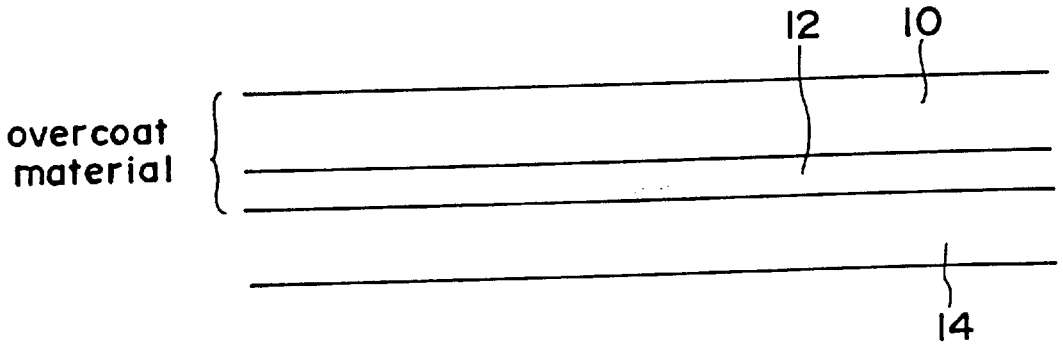
FIG. 2 is a diagram showing the overcoat material formed in the form of a layer on the ink film.
Figure 3A:
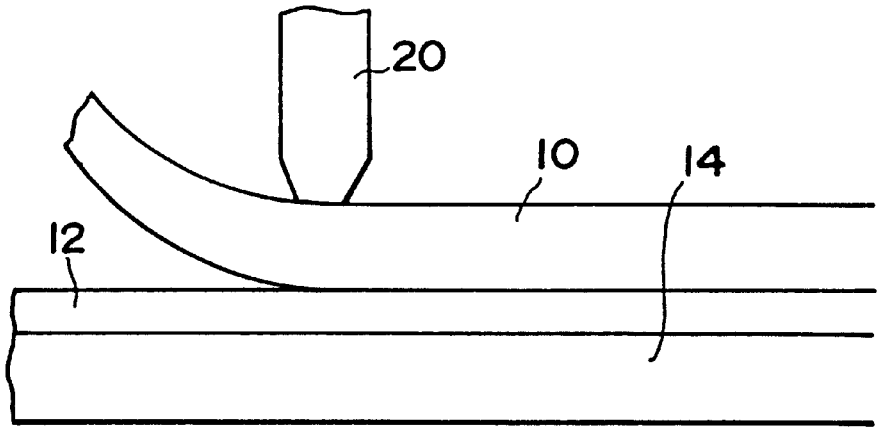
FIG. 3 (*a*) is a diagram showing the overcoat layer while it is being peeld off a substrate when a thermal head produces a proper quantity of heat.
Figure 3B:
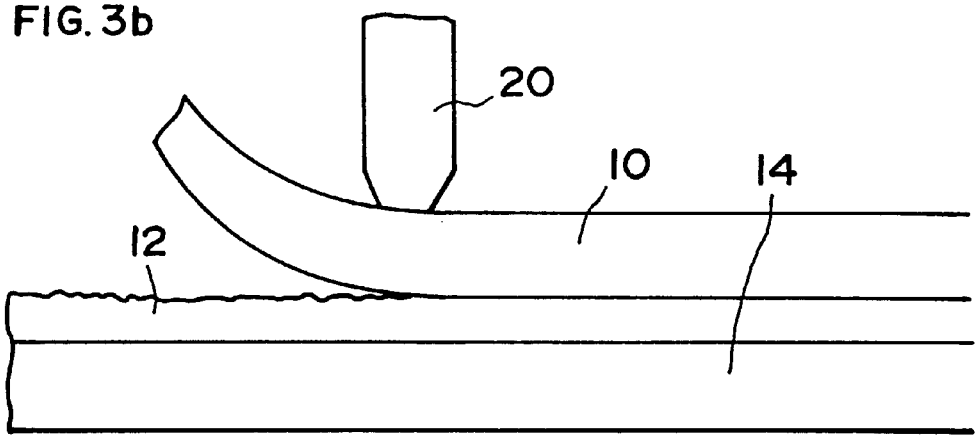
Figure 3C:
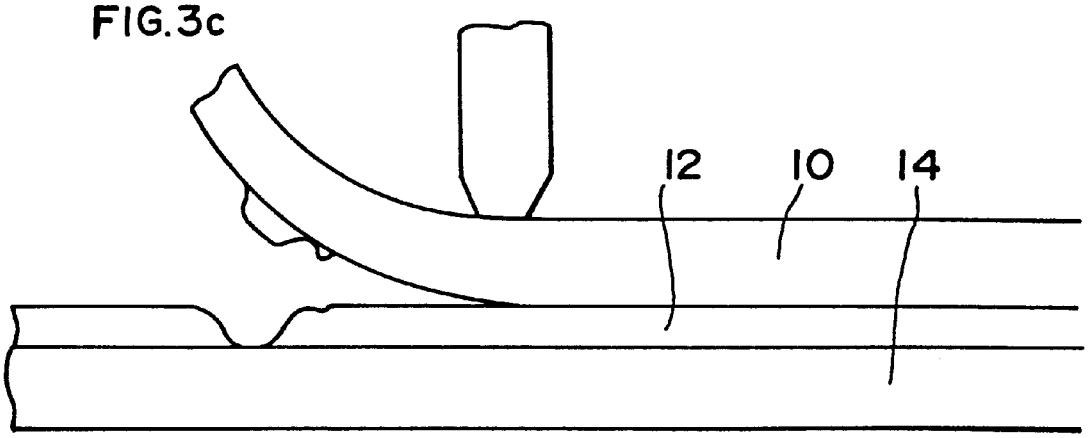
Figure 4A:
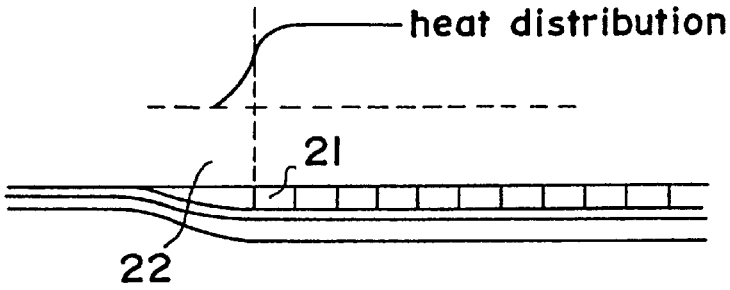
FIG.4a Prior Art
FIG. 4 (*a*) is a diagram showing the construction of thermal head of a conventional heat transfer printer.
Figure 4B:
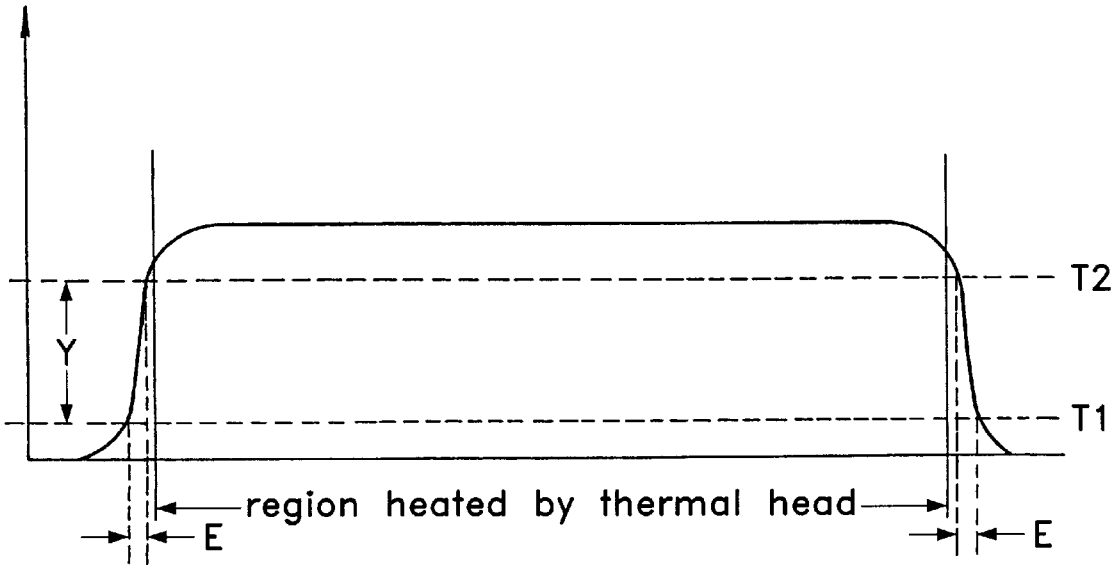
FIG.4b Prior Art
Figure 6:
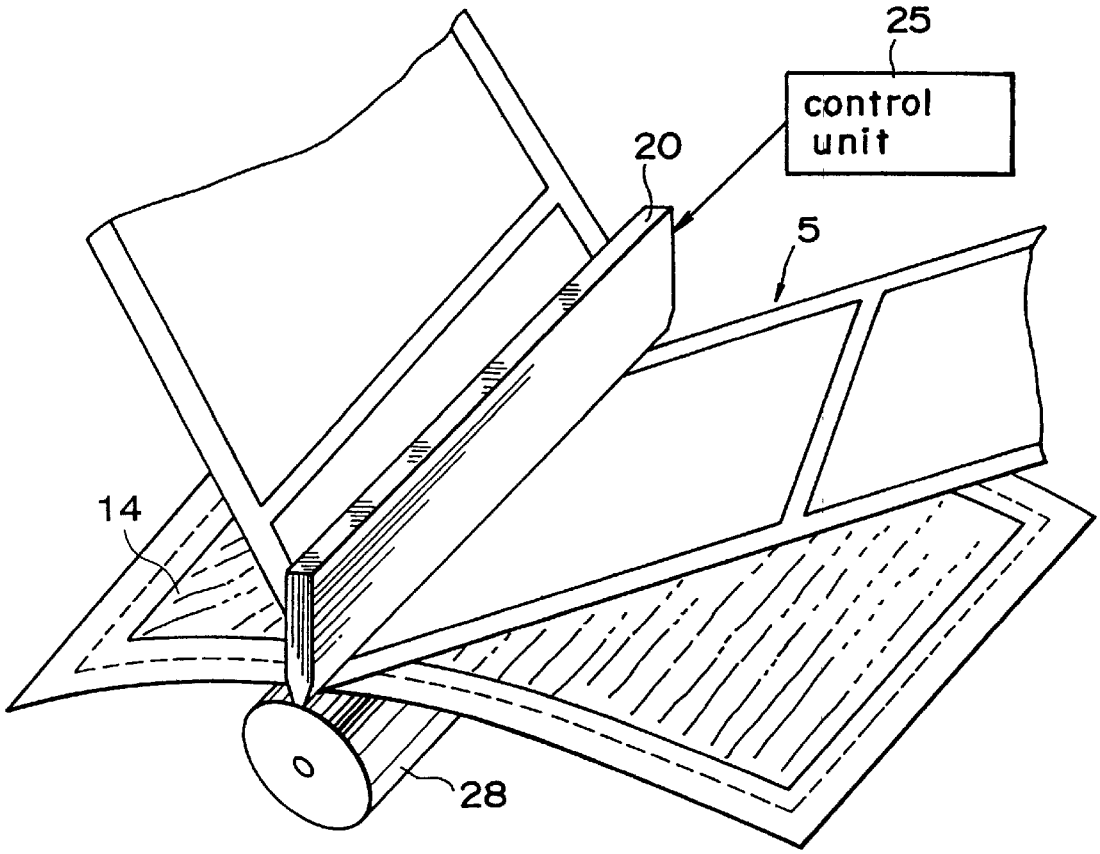
FIG. 6 is a diagram schematically showing the construction of a heat transfer printer according to the invention.

FIG. 6 schematically shows the construction of a heat transfer printer according to the present invention. It is seen that the overcoat material of an ink film 5, like the one shown in FIG. 1, is being transferred onto coder image 14 on a recording paper. The ink film 5 and the recording paper are nipped between a thermal head 20 and a platen roller 28. The thermal head 20 is energized in this state to heat heaters for printing or transferring the overcoat material.

As is well known, the thermal head 20 has a multiplicity of heaters 21 arranged in a row longitudinally along the thermal head 20. With conventional thermal heads, the heaters are provided only in a region specified for the transfer of the overcoat material, whereas with the thermal head 20 which is a first embodiment of the invention, heaters are provided also in regions other than this region.

Figure 7:
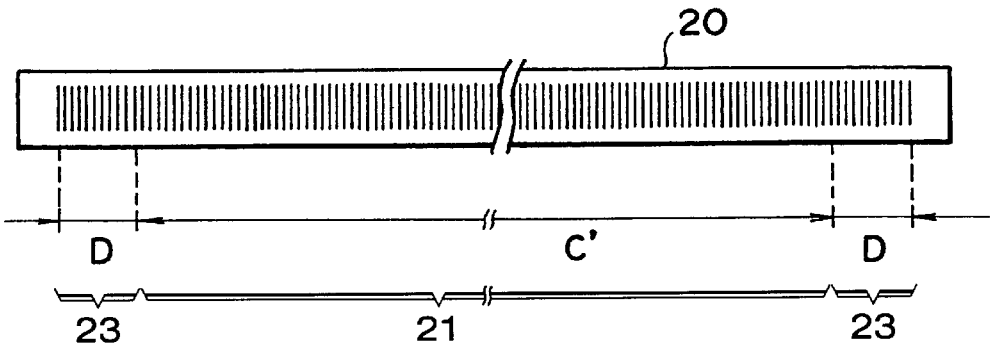
FIG. 7 is a diagram showing heaters as arranged in a thermal head which is a first embodiment of the present invention.
Figure 9A:
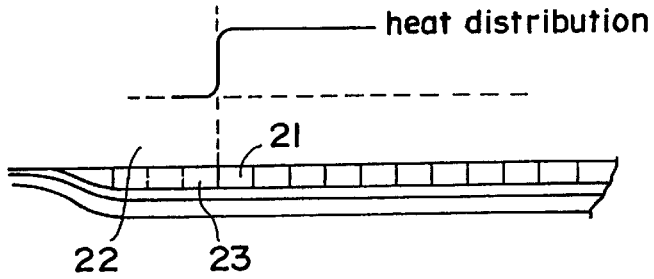
FIG. 9 (*a*) is a diagram showing the construction of the thermal head as the first embodiment of the present invention.
Figure 9B:
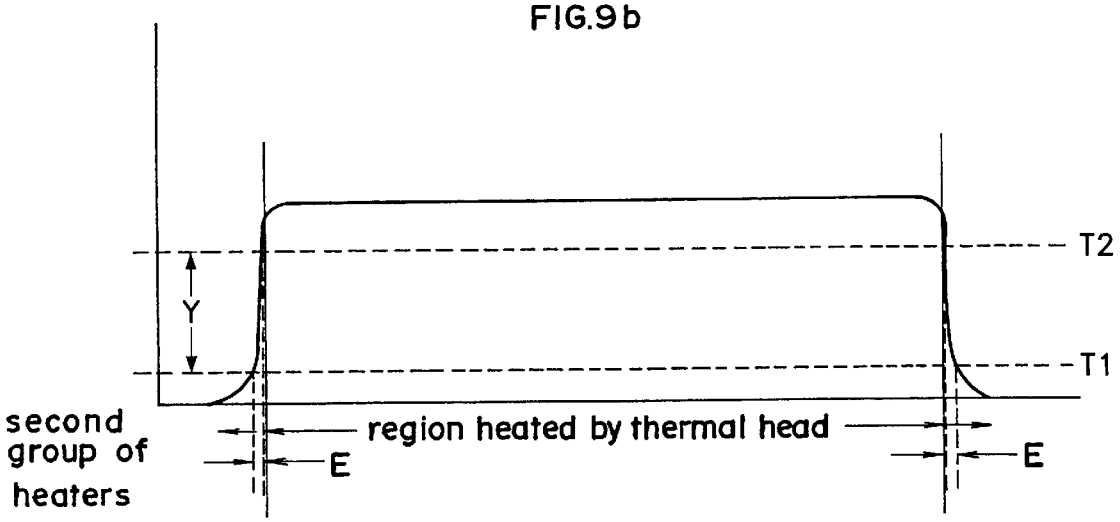

Stated more specifically with reference to FIG. 7, the thermal head 20, i.e., the first embodiment of the invention, has a first group of heaters 21 in a portion C' corresponding to the overcoat material transfer region indicated at C in FIG. 1 and additionally, has a second group of heaters 23 (see FIG. 9 (*a*)), which functions as a heat insulating portion, in each D region indicated in FIG. 1 (within the width of the recording paper according to the embodiment) outside the region C'. The second group of heaters 23 present in the respective regions D acts to cause the overcoat material to peel off neatly along its transfer boundary portions 8*a* although they do not contribute to the transfer of the overcoat material. To the heaters of the first group 21 present in the portion C' corresponding to the transfer region C, an energization control unit 25 applies a voltage as pulse width-modulated for the individual heaters according to printing data.

With the present embodiment, the second group of heaters 23 is used as the heat insulating portion. The heaters which are usually used for the thermal head 20 are individually heat-insulated in view of the need to avoid thermal interference between the adjacent heaters. Accordingly, when held unenergized, the second group of heaters 23 is thermally insulated from the first group of heaters 21, which is adjacent to the second group 23, and energized for heat generation. This produces a great temperature difference between the first heater group 21 and the second heater group 23.

Besides heaters, a material having a very small thermal conductivity is usable for providing the heat insulating portion. Whereas the heat insulating portion comprising heaters as in the present embodiment is very easy to manufacture.

Figure 8:
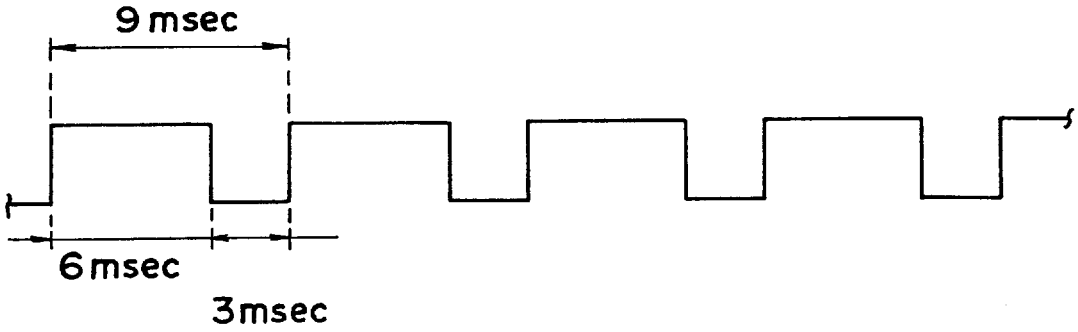
FIG. 8 is a diagram showing an example of pulse voltage to be applied to the thermal head of the printer of the present invention for transferring the overcoat material.

FIG. 8 shows voltage pulses which are given by the energization control unit 25 to the first group of heaters 21 of the thermal head 20 when the overcoat material is to be transferred onto color images 14. In this case, no voltage is applied to the second groups of heaters 23.

The voltage pulses have a period of 9 msec, which is a transfer time, and which includes 6 msec of voltage application time and 3 msec during which no voltage is applied.

In the case where the first group of heaters 21 is energized for the above-mentioned length of time, the overcoat layer 12 can be free of thermal deterioration, neatly peels off the substrate 10 and therefore exhibits a satisfactory gloss over its surface when transferred. Accordingly, this length of time is set at 6 msec. On the other hand, the period during which no voltage is applied is set at 3 msec, and this cessation time is provided for preventing the thermal head 20 from overheating.

In the case where the overcoat material is transferred using the thermal head 20, which has the second groups of heaters 23 as described above, the thermal head 20 has a heat distribution shown in FIGS. 9 (*a*) and (*b*). The pulse voltage shown in FIG. 8 is applied to the first group of heaters 21 by the energization control unit 25, causing these heaters to produce heat at a specified temperature. However, no voltage is applied to the second groups of heaters 23, hence no heat generation occurs by the second groups.

Since the first heater group 21 is fully heat-insulated from the second heater group 23 as described above, there is a very great temperature difference between the first group 21 and the second group 23 as seen in FIG. 9 (*b*), in other words, an abrupt temperature change. The abrupt temperature change thus provided between the overcoat material transfer region C and the nontransfer region D greatly diminishes the region (region E in FIG. 9 (*b*)) where the overcoat layer adheres to the recording paper with very low stability, consequently permitting the overcoat layer 12 to peel off very neatly at each transfer region end portion with respect to the transfer boundary portions 8*a*.

Figure 10:
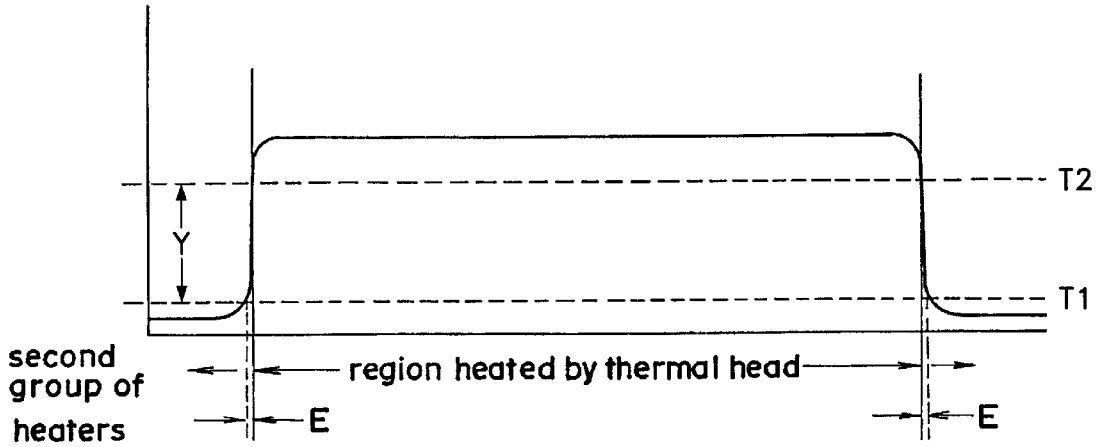
FIG. 10 is a diagram showing a heat distribution in the heating region of a thermal head which is a second embodiment of the present invention.

Although no voltage is applied to the second heater groups 23 according to the first embodiment, a second embodiment of the invention has second groups of heaters 23 which are caused to produce heat at a temperature lower than a temperature T1 at which the overcoat material can be adhered, as seen in FIG. 10. In the case where the ink film 5 stretches in the direction X of transport (see FIG. 1) when heated, the transfer of the overcoat material produces a load acting between the overcoat material transfer region on the film which stretches on heating and the overcoat material nontransfer region on the film which remains unstretched, with the resulting likelihood that the overcoat material will not be smoothly transferred at the end portions E of the transfer region C. Accordingly, if the second groups of heaters 23 are caused to generate heat at a temperature lower than the temperature T1 at which the overcoat material adheres, in the second embodiment, the film portion in the nontransfer region D also stretches slightly to mitigate a load, ensuring smooth transfer of the overcoat material at the end portions E of the transfer region C.

When the overcoat material is transferred according to the second embodiment, the energization time for the first heater group 21 in the thermal head 20 is set at 6 msec, and the energization time for the second heater groups 23 at 10 to 25% of that for the first group 21, e.g., at 1 msec. These values are examples; the thermal head 20 is so adapted as to produce a quantity of heat ensuring reliable transfer in the transfer region and a quantity of heat which will not effect transfer in the other region. Since the quantity of heat required for transfer is closely related to the construction and composition of the overcoat material, the optimum quantities of heat to be produced by the first heater group 21 and the second heater groups 23 differ with different overcoat materials.

The energization time for the heaters located in the vicinity of the end portions E of the overcoat material transfer region may be made shorter from position to position outward to give a gradient to the temperature distribution so that the heat will be transferred less efficiently to the region where the overcoat material is not to be transferred.

In the case where the ink film 5 used does not have the properties to stretch in the direction of transport when heated, the first embodiment of the invention achieves satisfactory results.

Figure 5:
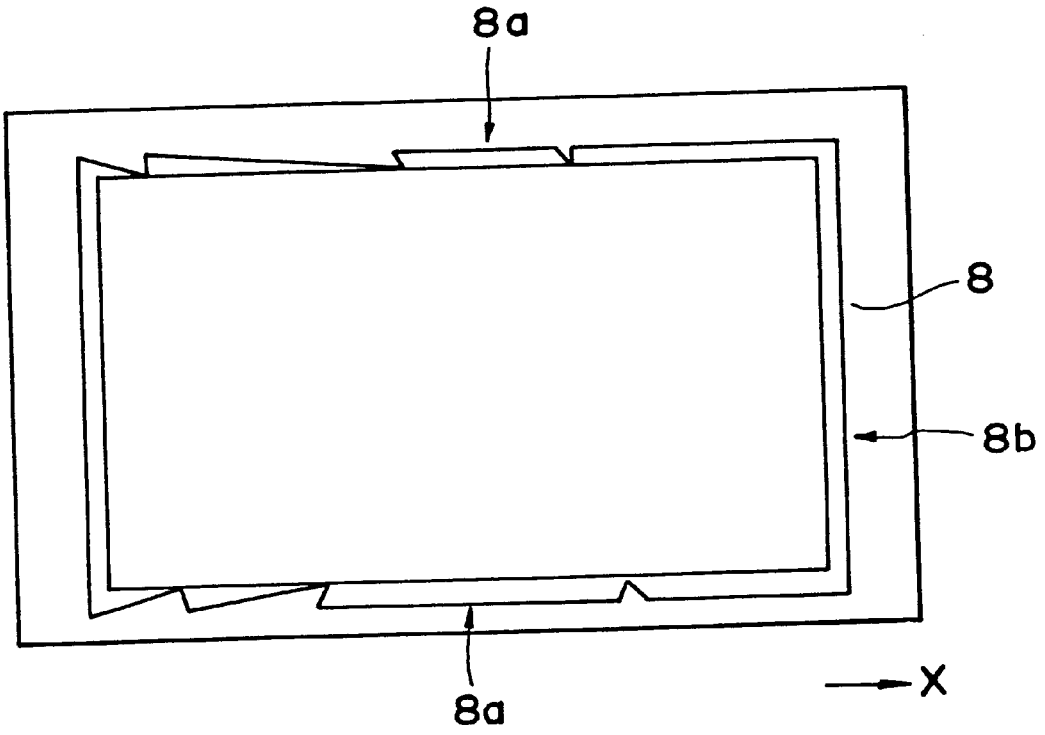
FIG. 5 is a diagram showing recording paper and the overcoat material as transferred thereto in a faulty state, such being inadequate to cover a color image on the paper.

While the foregoing embodiments are adapted to effect smooth transfer of the overcoat material with respect to the widthwise direction of the recording paper, the thermal head 20 is likely to start to transfer the overcoat material before being fully warmed up for the transfer. Faulty transfer of the overcoat material will then occur with respect to the recording paper transport direction X (transfer boundary portions 8*b*, see FIG. 5).

To obviate such a fault that would occur in the heat transfer printer embodying the present invention, a pulse voltage as shown in FIG. 8 is applied by the energization control unit 25 to the thermal head 20 without transporting the recording paper, for example, by an amount corresponding to five lines when the transfer of the overcoat material is to be started for the first line. The thermal head 20 can then be heated up to a temperature sufficient for the transfer of the overcoat material so as to transfer the material in the best condition from the start. The material can be transferred neatly from the first line since the thermal head 20 to be preheated in this way remains cold as held in contact with the substrate portion at the line preceding the first line.

Similarly, the transfer can be started in the best condition also by applying the pulse voltage to the first group of heaters 21 for 10 to 25% of the transfer energization time, e.g., for 1 msec, and thereby preheating the first group 21 before the transfer of the overcoat material.

After the thermal head 20 has been preheated as described above, the overcoat material is transferred with the usual quantity of heat, and the thermal head 20 is deenergized before the final line is reached. This removes heat from the ink film 5, recording paper and heaters before the thermal head 20 reaches the ink portion of the film 5 to be peeled off, whereby the end portion 8*b*, in the paper transport direction X, of the overcoat material transfer region can be transferred neatly.

If the overcoat material can be transferred onto the color image 14 in a satisfactory state in the the manner described, the overcoat material as peeled off has a neat periphery. This eliminates the likelihood that the color image 14 will be impaired by fingerprints, chemicals or light at the boundary portion of the transferred overcoat material. Further when the overcoat material is torn off because of incomplete transfer of the material at the boundary portion, fragments of the overcoat material will be released to adhere to another sheet of recording paper subsequently transported, entailing the problem that the image to be printed will be locally left unprinted at the fragment-adhering portions of the subsequent sheet, or fragments of the overcoat material will adhere to the surface of the paper discharge roller, giving rise to the mechanical problem of faulty transport of paper.

However, these problems are reliably avoidable. Additionally, the neat periphery of the overcoat material as transferred onto the color image on the recording paper gives an improved aesthetic appearance to the print.

Although the heat transfer printer disclosed and embodying the invention is of the multitone type having a pulse width modulation system, the application of the invention is not limited only to printers of this type. The invention is also applicable, for example, to multitone heat transfer printers and monochromatic printers of the type using a pulse voltage which is controlled with the pulse width held constant.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A heat transfer printer for producing an image on a sheet, the heat transfer printer comprising:

an ink member;

a transparent overcoat material; and a thermal head pressed against a sheet with the ink member or the overcoat material interposed therebetween for forming the image on the sheet by heating the ink member in accordance with image data and for transferring the overcoat material onto the image formed by heating the overcoat material, the thermal head including a heat insulating portion having a second heat generating portion, at a region other than a region where the overcoat material is transferred, for generating heat to temper heat produced within the overcoat material transfer region.

2. A heat transfer printer as claimed in claim 1, wherein said ink member has a plurality of ink faces having colors different from each other.

3. A heat transfer printer as claimed in claim 1, wherein said thermal head has a first heater at the overcoat material transfer region and has a second heater in the second heat generating portion, said second heater has similar structure to the first heater.

4. A heat transfer printer as claimed in claim 3, further comprising a controller to operate said first heater and said second heater when the overcoat material is transferred.

5. A heat transfer printer as claimed in claim 3, wherein said overcoat material is disposed on a film, and further comprising:

a controller which controls the first heater so as to produce heat at a first temperature and controls the second heater so as to produce heat at a second temperature when the overcoat material is transferred on the image, said first temperature being higher than a temperature at which the overcoat material can be reliably adhered to the image and said second temperature being lower than a temperature at which the overcoat material can be adhered to the image.

6. A heat transfer printer which forms an image on a sheet by heating an ink member in accordance with image data and thereafter transfers a transparent overcoat material on the image formed, said heat transfer printer comprising:

heating means pressed against a sheet with the ink member or the overcoat material interposed therebetween, said heating means having a heat generating portion including a plurality of heaters for producing heat and a heat insulating portion, including at least one operable heater for producing heat, positioned adjacent to said heating portion for tempering heat produced in the heating portion; and control means for selectively operating the plurality of heaters in the heat generating portion when the image is formed on the sheet, and operating each of the heaters in the heat generating portion when the overcoat material is transferred on the image formed.

7. A heat transfer printer as claimed in claim 6, wherein said control means applies a pulse voltage to the heaters in the heat generating portion.

8. A heat transfer printer as claimed in claim 6, wherein said ink member has a plurality of ink faces having colors different from each other.

9. A heat transfer printer as claimed in claim 6, wherein said heat generating portion corresponds to a transfer width of the overcoat material.

10. A heat transfer printer as claimed in claim 6, wherein said control means operates the heaters in the heat generating portion and the at least one operable heater in the insulating portion when the overcoat material is transferred on the image.

11. A heat transfer printer as claimed in claim 6, wherein said overcoat material is disposed on a film, and said control means operates the heaters in the heat generating portion to produce heat at a first temperature and operates the at least one operable heater in the heat insulating portion to produce heat at a second temperature when the overcoat material is transferred on the image, said first temperature being higher than a temperature at which the overcoat material can be reliably adhered to the image and said second temperature being lower than a temperature at which the overcoat material can be adhered to the image.

12. A thermal head provided in a heat transfer printer which forms an image on a sheet by heating an ink member in accordance with image data, said thermal head comprising:

a heating portion including a plurality of operable heaters for producing heat, said heaters being aligned in a predetermined direction; and a heat insulating portion, having at least one operable heater for producing heat, provided adjacently to and aligned with said heating portion in said predetermined direction, for tempering heat produced in the heating portion.

13. In a heat transfer printer comprising heating means, pressed against a sheet with an ink member or a transparent overcoat material interposed therebetween, having a first heating portion for producing heat and an insulating portion, positioned adjacent to the heating means, having a second heating portion for producing heat, a method comprising the steps of:

operating said first heating portion of the heating means in accordance with image data;

transferring an ink on a sheet by heating the ink member with the first heating portion of the heating means to form an image on the sheet;

operating the first heating portion of the heating means to transfer the overcoat material on the image when image formation is completed; and operating the second heating portion of the insulating portion at a temperature lower than a predetermined temperature when the overcoat material is transferred on the image.

14. A method as claimed in claim 13, wherein said predetermined temperature is lower than a temperature at which the overcoat material can be adhered to the image.

15. In a heat transfer printer which forms an image on a sheet by heating an ink member with heating means in accordance with image data, a method for transferring a transparent overcoat material on the image comprising the steps of:

heating a transfer region in the heating means at a first temperature, at said transfer region the overcoat material being transferred to the image; and heating a region other than said transfer region in the heating means at a second temperature, said first temperature being higher than a temperature at which the overcoat material can be reliably adhered to the image, and said second temperature being lower than a temperature at which the overcoat material can be adhered to the image.

16. A heat transfer printer for producing an image on a sheet and for coating the image with an overcoat material, said heat transfer printer comprising a thermal head having, an array of heaters aligned within a width which is less than a width of the overcoat material, the array having a first end and a second end, and two heat insulating portions, wherein a heat insulating portion is positioned at the first end and the second end, respectively.

17. A heat transfer printer in accordance with claim 16, wherein each of the heat insulating portions has a structure, and the structure of each heat insulating portion is substantially similar to a structure of the heaters of the array.

18. A heat transfer printer in accordance with claim 16, further comprising a driver which is electrically connected to the array of heaters and electrically insulated from the heat insulating portions.

19. A heat transfer printer in accordance with claim 16, further comprising a driver which is electrically connected to both the array of heaters and the heat insulating portions, wherein the driver drives the array of heaters to a predetermined temperature at which the overcoat material adheres to the image on the sheet and drives the heat insulating portions at a temperature lower than the predetermined temperature.

* * * * *